US011225094B2

(12) United States Patent
Sasaki

(10) Patent No.: US 11,225,094 B2
(45) Date of Patent: Jan. 18, 2022

(54) LIQUID DISCHARGING APPARATUS

(71) Applicant: Seiko Epson Corporation, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 790 days.

(21) Appl. No.: 16/065,296

(22) PCT Filed: Nov. 14, 2016

(86) PCT No.: PCT/JP2016/083687

§ 371 (c)(1),
(2) Date: Jun. 22, 2018

(87) PCT Pub. No.: WO2017/110301

PCT Pub. Date: Jun. 29, 2017

(65) Prior Publication Data

US 2021/0162783 A1 Jun. 3, 2021

(30) Foreign Application Priority Data

Dec. 22, 2015 (JP) ..... JP2015-249399

(51) Int. Cl.
*B41J 15/00* (2006.01)
*B41J 15/04* (2006.01)
(Continued)

(52) U.S. Cl.
CPC ..... *B41J 15/042* (2013.01); *B41J 2/01* (2013.01); *B41J 11/002* (2013.01); *B41J 29/17* (2013.01); *B65H 20/02* (2013.01)

(58) Field of Classification Search
CPC . B41J 15/042; B41J 11/002; B41J 2/01; B41J 29/17; B65H 20/02
See application file for complete search history.

(56) References Cited

U.S. PATENT DOCUMENTS 8,746,834 B2 6/2014 Toya
9,329,534 B2 * 5/2016 Hatazaki ..... G03G 15/2025
(Continued)

FOREIGN PATENT DOCUMENTS

EP 2730419 A 5/2014
JP 2003-220695 A 8/2003
(Continued)

OTHER PUBLICATIONS

Machine translation of JP 2013-069773, published on Sep. 2013.*
International Search Report cited in PCT/JP2016/083687, dated Dec. 6, 2016. (2 pages).

*Primary Examiner* — Huan H Tran
(74) *Attorney, Agent, or Firm* — Workman Nydegger

(57) ABSTRACT

A liquid discharging apparatus is provided capable of preventing liquid from being discharged onto a medium to which any foreign substances adhere. A printing apparatus (10) (liquid discharging apparatus) includes a holding member (21) configured to hold a roll body (R1) on which a medium (M) is wound, a transport unit (40) configured to transport the medium (M) fed from the roll body (R1) held by the holding member (21) along a transport path (FP), a discharging unit (61) configured to discharge liquid onto the medium (M) transported by the transport unit (40), and a vibration unit (34) configured to apply vibration to the medium (M) being transported from the holding member (21) to the transport unit (40). In the transport path (FP), a path on which the medium M to be subjected to vibration by the vibration unit (34) is transported is referred to as a vibration transport path (FP1), and the vibration transport path (FP1) is configured to extend vertically upward as approaching from the holding member (21) to the transport unit (40).

4 Claims, 3 Drawing Sheets

(51) Int. Cl.

| | |
|---|---|
| ***B41J 2/01*** | (2006.01) |
| ***B41J 11/00*** | (2006.01) |
| ***B41J 29/17*** | (2006.01) |
| ***B65H 20/02*** | (2006.01) |

(56) References Cited

U.S. PATENT DOCUMENTS

| | | | | |
|---|---|---|---|---|
| 2012/0013956 | A1 | 1/2012 | Toya | |
| 2014/0270867 | A1 | 9/2014 | Hatazaki | |
| 2016/0200121 | A1* | 7/2016 | Watanabe | B41J 11/0085 347/16 |
| 2017/0225470 | A1* | 8/2017 | Goto | B41J 2/165 |

FOREIGN PATENT DOCUMENTS

| | | | | |
|---|---|---|---|---|
| JP | 2006-069783 | * | 3/2006 | B65H 20/20 |
| JP | 2008-230787 | A | 10/2008 | |
| JP | 2009149028 | A | 7/2009 | |
| JP | 2012-020550 | | 2/2012 | |
| JP | 2012-048107 | A | 3/2012 | |
| JP | 2012-223908 | | 11/2012 | |
| JP | 2013-169773 | | 9/2013 | |
| JP | 2013-220873 | A | 10/2013 | |
| JP | 2014-021337 | A | 3/2014 | |
| JP | 2014-094549 | A | 5/2014 | |
| JP | 2014-174451 | A | 9/2014 | |

* cited by examiner

LIQUID DISCHARGING APPARATUS

TECHNICAL FIELD

The present invention relates to a liquid discharging apparatus such as an ink jet printer.

BACKGROUND ART

In the related art, ink jet printing apparatuses, included in examples of liquid discharging apparatuses, are known that perform printing by discharging ink as an example of liquid from a discharging unit onto a medium such as a sheet of paper. Among such printing apparatuses, there is a type of printing by discharging ink onto a medium fed from a roll body on which the medium is wound (for example, PTL 1).

CITATION LIST

Patent Literature

[PTL 1] JP-A-2014-94549

SUMMARY OF INVENTION

Technical Problem

Incidentally, in the printing apparatuses as described above, depending on the use environment or the use state of the device, any foreign substances, such as dust and fluff, may adhere to the front surface of the medium fed from the roll body. In this case, dirt adhering to the medium contacts the discharging unit or affects the landing accuracy of ink discharged from the discharging unit, and thus may reduce the print quality.

Note that such an actual situation is not only for printing apparatuses but also mostly common with liquid discharging apparatuses that discharge liquid from a discharging unit onto a medium fed from a roll body.

The present invention has been made in view of the above circumstances. An advantage of an aspect of the invention is to provide a liquid discharging apparatus capable of preventing liquid from being discharged onto a medium to which any foreign substances adhere.

Solution to Problem

Hereinafter, a description is given of the measures for solving the problem and the advantages of the measures.

A liquid discharging apparatus for solving the problem includes a holding member configured to hold a roll body on which a medium is wound, a transport unit configured to transport the medium fed from the roll body held by the holding member along a transport path, a discharging unit configured to discharge liquid onto the medium transported by the transport unit, and a vibration unit configured to apply vibration to the medium being transported from the holding member to the transport unit, and a path on which the medium to be subjected to vibration by the vibration unit is transported, in the transport path, is referred to as a vibration transport path, and the vibration transport path is configured to extend vertically upward as approaching from the holding member to the transport unit.

With the configuration, the medium fed from the roll body held by the holding member is vibrated by the vibration unit before reaching the transport unit. Further, the time when the vibration is applied to the medium by the vibration unit is when the medium is transported on the vibration transport path that extends vertically upward as approaching from the holding member to the transport unit. Accordingly, any foreign substances adhering to the medium being transported on the vibration transport path, when separated by the vibration, drop vertically downward while sliding on the surface of the inclined medium. In such a way, with this configuration, the medium to which any foreign substances adhere is prevented from being transported downstream from the vibration transport path in a transport direction, and thus liquid is prevented from being discharged onto the medium to which the foreign substances adhere.

It may be desirable that the liquid discharging apparatus includes a heating unit configured to heat the medium being transported on, a path that is downstream from the vibration transport path in the transport direction and upstream from the transport unit in the transport direction, in the transport path.

In a case where liquid is discharged onto a preheated medium, applying vibration to the medium after heated may reduce the temperature of the medium. Further, in some cases, applying vibration to a medium as well as heating the medium may reduce the heating efficiency of the medium. In this regard, with the configuration described above, the medium is heated downstream from the vibration transport path in the transport direction. Accordingly, it is prevented that either the temperature of the medium is reduced or the heating efficiency of the medium is reduced when the liquid is discharged onto the heated medium.

It may be desirable that the liquid discharging apparatus includes a guide unit having a guide surface constituting the vibration transport path, and the vibration unit vibrates the guide surface to apply vibration to the medium being transported from the holding member to the transport unit.

With the configuration described above, the guide surface constituting the vibration transport path is vibrated, and thus the medium being transported on the vibration transport path is subjected to vibration. Accordingly, a configuration that vibrates the medium being transported on the vibration transport path is easily provided.

In the liquid discharging apparatus, it may be desirable that the guide unit is provided vertically above the holding member.

Even when the medium is wound back onto the roll body held by the holding member after the liquid discharging apparatus is used, the state where the roll body is held by the holding member may allow any foreign substances to be deposited on the top face (front surface) of the roll body (medium) under the circumstance of using the liquid discharging apparatus again. In this regard, with the configuration described above, since the guide unit is provided vertically above the holding member, the guide unit functions as a hood for covering the roll body held by the holding member. Therefore, any foreign substances is prevented from being deposited on the top face (front surface) of the roll body (medium) under the above circumstance.

A liquid discharging apparatus for solving the problem includes a holding member configured to hold a roll body on which a medium is wound, a transport unit configured to transport the medium fed from the roll body held by the holding member along a transport path in a transport direction, a discharging unit configured to discharge liquid onto the medium transported by the transport unit, a vibration unit configured to apply vibration to the medium being transported from the holding member to the transport unit, and an airflow generating unit configured to generate an airflow along a surface of the medium being transported on at least one of a path which is referred to as a vibration transport path of the transport path and on which the medium to be subjected to vibration by the vibration unit is transported and a path of the transport path that is downstream from the vibration transport path in a transport direction and upstream from the transport unit in the transport direction.

With the configuration, the medium fed from the roll body held by the holding member is vibrated by the vibration unit before reaching the transport unit. Further, on the front surface of the medium being transported on at least one of the vibration transport path to be subjected to vibration by the vibration unit and the path that is downstream from the vibration transport path and upstream from the transport unit, an airflow is generated by the airflow generating unit. Accordingly, foreign substances separated from the surface of the medium by vibrating are removed from the front surface of the medium by the airflow.

In such a way, with this configuration, the medium to which any foreign substances adhere is prevented from being transported downstream from the vibration transport path in a transport direction, and thus liquid is prevented from being discharged onto the medium to which the foreign substances adhere.

DESCRIPTION OF EMBODIMENTS

One exemplary embodiment in which a liquid discharging apparatus is embodied in a printing apparatus will be described below with reference to the accompanying drawings. Note that the printing apparatus according to the exemplary embodiment is an ink jet printer configured to form characters and images by discharging ink onto a medium such as a sheet of paper.

Figure 1:
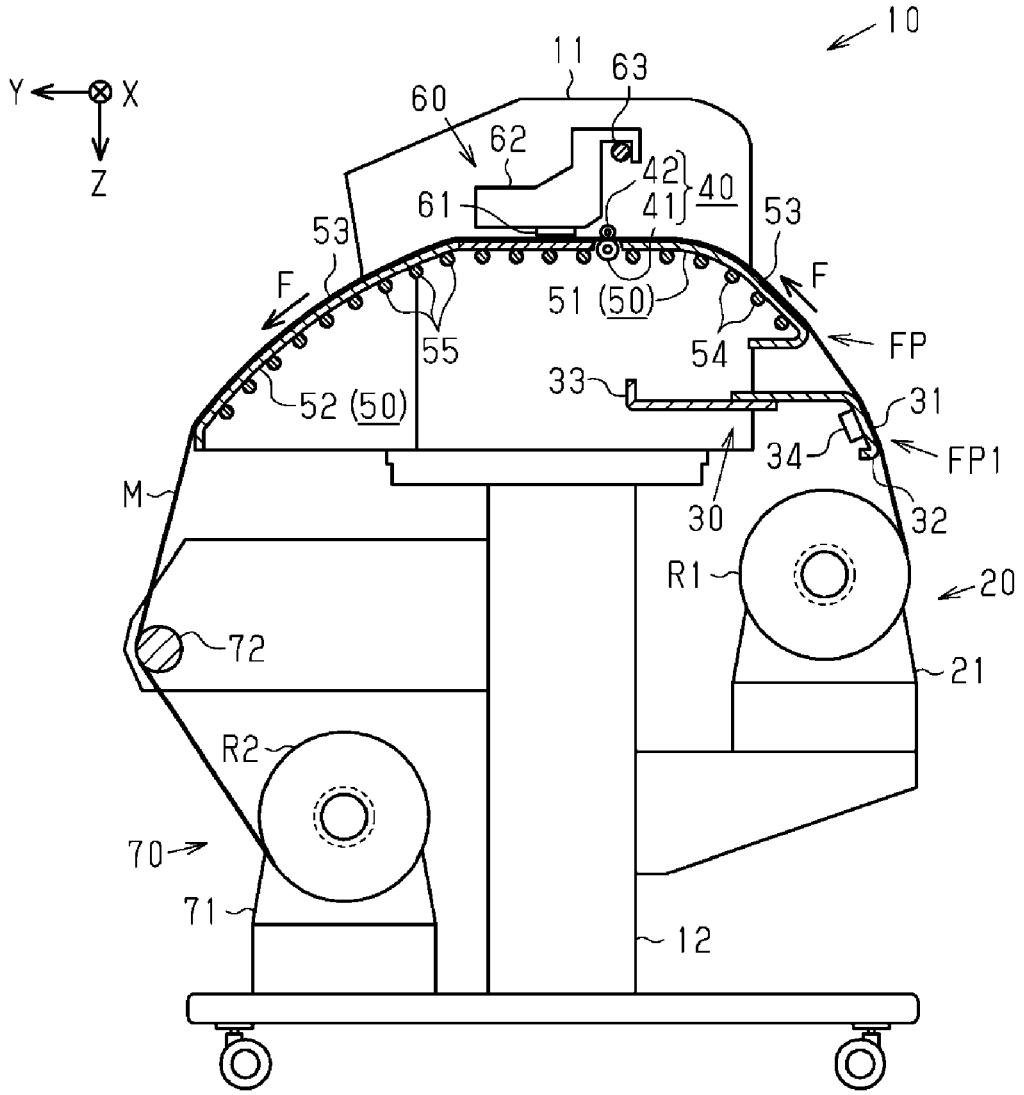
FIG. 1 is a side view schematically illustrating a configuration of a printing apparatus according to one exemplary embodiment.

As illustrated in FIG. 1, a printing apparatus 10 includes, along a transport direction of a medium M, a feeding unit 20 that feeds the medium M which is wound in a roll shape, a guide unit 30 that guides the medium M, a transport unit 40 that transports the medium M, a support unit 50 that supports the medium M, a printing unit 60 that performs printing on the medium M, and a winding unit 70 that winds the medium M. The printing apparatus 10 also includes a housing 11 that accommodates some constituent members of the apparatus and a leg portion 12 that supports the housing 11 and the like.

Note that, in the following description, a direction in which the medium M is transported is referred to as a "transport direction F", and a path (a moving path of the medium M) on which the medium M is transported from the feeding unit 20 to the winding unit 70 is sometimes referred to as a "transport path FP". Further, a width direction of the printing apparatus 10 is referred to as a "width direction X", a front-back direction of the printing apparatus 10 is referred to as a "front-back direction Y", and a vertical direction of the printing apparatus is referred to as a "vertical direction Z". Note that, in the exemplary embodiment, the width direction X, the front-back direction Y, and the vertical direction Z are directions that cross (are orthogonal to) each other, and the transport direction F is a direction that crosses (is orthogonal to) the width direction X.

The feeding unit 20 includes a holding member 21 configured to detachably hold a roll body R1 on which the medium M is wound in a roll shape. Further, the feeding unit 20 rotates the roll body R1 in one direction (counterclockwise direction in FIG. 1) to feed the medium M that has been wound off from the roll body R1, and rotates the roll body R1 in the other direction (clockwise direction in FIG. 1) to wind back the medium M that has been fed from the roll body R1.

The guide unit 30 includes a guide member 32 having a guide surface 31 that constitutes a part of the transport path FP, a rail member 33 that slidably supports the guide member 32, and a vibration unit 34 that vibrates the guide member 32 (guide surface 31). In the width direction X, the length of the guide unit 30 is longer than the length of the maximum medium M of the medium M, on which the printing apparatus 10 performs printing. Further, the guide surface 31 has a slope that is formed to extend vertically upward as approaching from the feeding unit 20 to the transport unit 40. The guide surface 31 of the guide unit 30 also guides transportation of the medium M while contacting the back surface of the medium M.

The rail member 33 movably supports the guide member 32 in a direction crossing both the width direction X and the vertical direction Z (front-back direction Y in the exemplary embodiment). Further, it may be desirable that when the vibration unit 34 vibrates the guide member 32, the rail member 33 is configured not to transmit the vibration, for example, by using a spring component or a damper component provided between the rail member 33 and the guide member 32.

Moreover, in the following description, a position (the position illustrated in FIG. 1) at which the guide member 32 extends back from the rail member 33 is sometimes referred to as an "extended position", and a position (the position illustrated in FIG. 2) at which the guide member 32 is retracted in the housing 11 is sometimes referred to as a "retracted position". Specifically, when the guide member 32 is located at the retracted position, the amount of extension of the guide member 32 from the housing 11 is maximum, whereas when the guide member 32 is located at the extended position, the amount of extension of the guide member 32 from the housing 11 is minimum.

Further, as illustrated in FIG. 1, when the rail member 33 is located at the extended position, the guide member 32 is placed vertically above the roll body R1 held by the holding member 21 of the feeding unit 20. Here, when the guide member 32 is placed at the extended position, in a planar view of the printing apparatus 10, it may be desirable that the guide member 32 hides at least a rotating shaft of the roll body R1, and it may be more desirable that the guide member 32 hides the entire roll body R1. Note that the roll body R1 referred to here is in a state where the medium M is wound to the maximum.

The vibration unit 34 is provided to be brought into contact with the guide member 32 on the side opposite to the guide surface 31 of the guide member 32. With the vibration unit 34, simply one vibration unit 34 may be provided at the center of the guide member 32 in the width direction X, or a plurality of guide members 32 may be provided over the width direction X. Moreover, the vibration unit 34 vibrates the guide member 32, thus applying vibration to the medium M guided to the guide surface 31 of the guide member 32.

The vibration unit 34 is also for vibrating the guide member 32, and may have, for example, the following configuration. To begin with, a vibration generating method of the vibration unit 34 may be a method of generating vibration by driving a motor having an output shaft with an eccentric weight (ERM: Eccentric Rotating Mass method). Further, the vibration generating method of the vibration unit 34 may be a method of utilizing vibration generated at a coil by time varying a difference between an electromagnetic force caused depending on a value of current flowing in the coil and a repulsive force between the coil and the magnet (LRA: Linear Resonant Actuator method). Furthermore, the vibration generating method of the vibration unit 34 may be a method of utilizing vibration generated by a piezoelectric element which expands or contracts depending on a value of applied voltage. Moreover, the vibration generating method of the vibration unit 34 may be a method of generating vibration through a vibrator, which periodically moves using a high-pressure gas and which serves as a power source.

Further, it may be desirable that the vibration unit 34 vibrates the guide member 32 at, for example, several tens of Hz to several hundreds of Hz. Furthermore, it may be desirable that the vibration unit 34 vibrates the guide member 32 in a direction crossing (desirably, orthogonal to) the guide surface 31. Note that an amplitude of the guide member 32 can be varied depending on the thickness of the medium M to be transported. The thickness may be, for example, about from 0.1 mm to 5 mm.

Further, in the following description, of the transport path FP, a path on which the medium M to be subjected to vibration by the vibration unit 34 is transported is sometimes referred to as a "vibration transport path FP1". In other words, in the exemplary embodiment, the vibration transport path FP1 is formed from the guide surface 31 of the guide member 32.

The transport unit 40 includes a driving roller 41, which undergoes a driving rotation while contacting the back surface of the medium M, and a driven roller 42, which undergoes a driven rotation while contacting the front surface of the medium M. Further, the transport unit 40 forward-rotates the driving roller 41 with the medium M nipped between the driving roller 41 and the driven roller 42, and thus transports the medium M fed from the feeding unit 20 along the transport path FP in the transport direction F. The transport unit 40 also backward-rotates the driving roller 41, and transports the medium M in the opposite direction to the transport direction F.

The support unit 50 includes a first support portion 51, which is provided upstream from the transport unit 40 in the transport direction, and a second support portion 52, which is provided downstream from the transport unit 40 in the transport direction.

The first support portion 51 is formed to extend vertically upward as approaching to the front of the printing apparatus 10. The first support portion 51 is also provided across the width direction X of the printing apparatus 10, as with the guide unit 30. Further, in the first support portion 51, a first heating unit 54, for heating the first support portion 51, is provided on the opposite side to the support surface 53, which supports the medium M.

The second support portion 52 is formed to extend vertically downward as approaching to the front of the printing apparatus 10 after approaching to the front of the printing apparatus 10. The second support portion 52 is also provided across the width direction X of the printing apparatus 10, as with the guide unit 30. Further, in the second support portion 52, a second heating unit 55 that heats the second support portion 52 is provided on the opposite side to the support surface 53 that supports the medium M.

Furthermore, a support surface 53 of the first support portion 51 and the second support portion 52 constitute a part of the transport path FP. Moreover, the support unit 50 supports the medium M that has been guided by the guide unit 30, supports the medium M that is to be subjected to printing by the printing unit 60, and supports the medium M that has been subjected to printing by the printing unit 60.

Incidentally, the first support portion 51 and the second support portion 52 are heated by the driving of the first heating unit 54 and the second heating unit 55, and transfers heat to the medium M that is in contact with the support surface 53 to heat the medium M. In this regard, it may be desirable that the support unit 50 is formed of a metallic material with high thermal conductivity, such as aluminum and stainless steel.

Note that the first heating unit 54 is to heat the medium M being transported on a path that is downstream from the vibration transport path FP1 in the transport direction and upstream from the transport unit 40 in the transport direction, that is, the medium M being supported by the support surface 53 of the first support portion 51. In this regard, in the exemplary embodiment, the first heating unit 54 corresponds to an example of a "heating unit".

The printing unit 60 includes a discharging unit (e.g., a discharging head) that discharges ink as an example of liquid, a carriage 62 that supports the discharging unit 61, and a guide shaft 63 that supports the carriage 62 to be capable of reciprocating in the width direction X. Note that the movement of the carriage 62 in the width direction X may be performed by a mechanism that converts rotational motion of a motor into linear motion in the width direction X by using, for example, a pulley mechanism.

The printing unit 60 also performs printing on the medium M, based on a print job input to the printing apparatus 10. Specifically, ink is discharged from the discharging unit 61 onto the front surface of the medium M while the carriage 62 is moving in the width direction X, thus performing one-pass printing.

The winding unit 70 includes a holding unit 71 that detachably holds a roll body R2 on which the medium M is wound, and a tension bar 72 that applies tension (tensile force) to the medium M in a direction crossing the transport direction F. The winding unit 70 also rotates the roll body R2 in one direction (counterclockwise in FIG. 1) to wind the medium M which has been subjected to printing.

Further, in the exemplary embodiment, an amount of feeding the medium M and an amount of winding the medium M accompanied by driving of the feeding unit 20 and the winding unit 70 are controlled, and the tension (tensile force) applied to the medium M is thus adjusted. This way prevents the medium M being transported on the transport path FP from becoming wrinkled or slack, so that the medium M can be transported smoothly.

Incidentally, in the printing apparatus 10 as in the exemplary embodiment, electrostatic charges are easily generated on the medium M by separating the medium M from the roll body R1 when the medium M is fed from the roll body R1 for performing printing on the medium M. Further, since the holding member 21 is provided outside the housing 11, any foreign substances such as dirt and dust, when flying in the installation environment of the printing apparatus 10, may adhere to the charged medium M. In this case, discharging ink onto the medium M to which any foreign substances have adhered may result in a reduced print quality.

For that reason, in the exemplary embodiment, before the medium M fed from the roll body R1 held by the holding member 21 of the feeding unit 20 reaches the transport unit 40, the guide surface 31 (guide member 32) that is in contact with the back surface of the medium M is vibrated, and thus foreign substances adhering to the medium M are separated from the medium M. In other words, by applying vibration to the medium M being transported in the vibration transport path FP1, the foreign substances adhering to the medium M are separated from the medium M.

Next, a description of the operation of the printing apparatus 10 of the exemplary embodiment will be given with reference to FIG. 2 and FIG. 3.

First, a detailed description of the operation of the printing apparatus 10 during no printing will be given with reference to FIG. 2.

In the printing apparatus 10 of the exemplary embodiment, when a residual quantity of the roll body R1 held by the holding member 21 of the feeding unit 20 has run short or when printing on the medium M having a different length in the width direction X is to be started, the roll body R1 held by the holding member 21 of the feeding unit 20 is replaced. Note that in a case where part of the medium M remains fed from the roll body R1 when the roll body R1 on the feeding unit 20 is replaced, the part of the medium M is wound onto the roll body R1 and then the roll body R1 is replaced.

Figure 2:
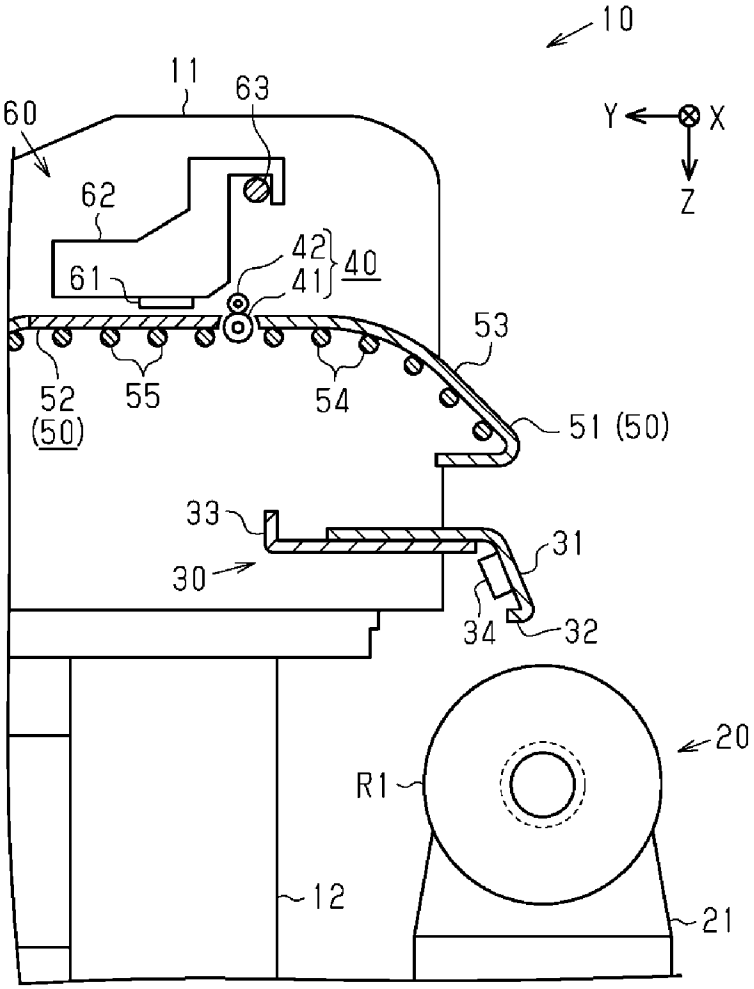
FIG. 2 is a side view of the printing apparatus in attaching/detaching a roll body.

As illustrated in FIG. 2, when the roll body R1 held by the holding member 21 of the feeding unit 20 is replaced, the guide member 32 is located at the retracted position by user operation. Therefore, the guide member 32 continuously located at the extended position may make difficult an attachment/detachment operation of the roll body R1 in the holding member 21 of the feeding unit 20, but such a difficulty is prevented.

On the other hand, when the use of the printing apparatus 10 is suspended with the roll body R1 remaining held by the holding member 21 of the feeding unit 20, the guide member 32 is located at the extended position by user operation. Accordingly, even when the use of the printing apparatus 10 is suspended for a long time (e.g., several days), any foreign substances are prevented from being deposited on the top portion of the roll body R1 held by the holding member 21 of the feeding unit 20. As a result, when the use of the printing apparatus 10 is restarted, an amount of foreign substances adhering to the medium M fed from the roll body R1 held by the holding member 21 of the feeding unit 20 is reduced.

Next, a detailed description of the operation of the printing apparatus 10 during printing will be given with reference to FIG. 3.

Figure 3:
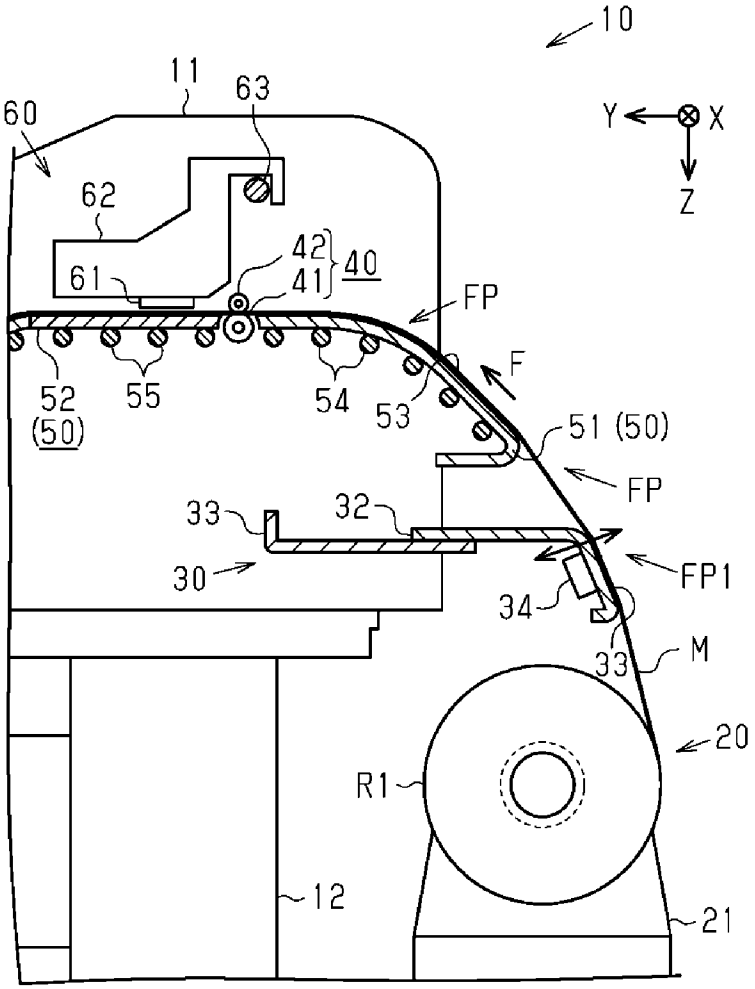
FIG. 3 is a side view of the printing apparatus in printing.

As illustrated in FIG. 3, in the printing apparatus 10 of the exemplary embodiment, the medium M fed from the roll body R1 held by the holding member 21 of the feeding unit 20 is guided to the guide member 32 (guide surface 31) that is vibrated by the vibration unit 34. Accordingly, the medium M fed from the roll body R1 is vibrated as illustrated by a solid line double-headed arrow in FIG. 3, and any foreign substances, when adhering to the front surface of the medium M, are separated from the front surface of the medium M and then drop down along the inclined surface of the medium M. Therefore, the medium M in which foreign substances adhere to its front surface is prevented from being transported downstream from the transport unit 40, and thus ink is prevented from being discharged onto that medium M.

Further, in the exemplary embodiment, the first support portion 51 that heats the medium M upstream from the guide unit 30 in the transport direction is provided in the transport direction F. Accordingly, the medium M to be transported in the transport direction F, after foreign substances are separated on the guide unit 30, is transported along the first support portion 51 while being preheated by the first support portion 51.

After that, the preheated medium M is subjected to printing by discharging ink from the discharging unit 61 with the medium M held by the second support portion 52. Subsequently, the medium M that has been subjected to printing is transported along the second support portion 52 while being primarily heated by the second support portion 52, and thus fixing of ink is accelerated. Furthermore, the medium M is applied with tension by the tension bar 72 and then wound onto the roll body R2 of the winding unit 70.

According to the exemplary embodiment described above, the following advantages are obtained.

(1) The medium M fed from the roll body R1 held by the holding member 21 of the feeding unit 20 is vibrated by the vibration unit 34 before reaching the transport unit 40. Further, the time when the vibration is applied to the medium M by the vibration unit 34 is when the medium M is guided to the guide surface 31 that extends vertically upward as approaching from the holding member 21 to the transport unit 40. Accordingly, foreign substances adhering to the front surface of the medium M, after separated by the vibration, drop vertically downward sliding on the front surface of the medium M. In such a way, the medium M to which any foreign substances adhere is prevented from being transported downstream from the vibration transport path FP1 in the transport direction, and thus liquid is prevented from being discharged onto the medium M to which the foreign substances adhere.

(2) Applying vibration to the medium M after the medium M is heated may reduce the temperature of the medium M. Further, in some cases, applying vibration to the medium M while heating the medium M may reduce the heating efficiency of the medium M. In this regard, in the exemplary embodiment described above, the medium M is heated downstream from the vibration transport path FP1 in the transport direction F. Accordingly, in a case where the medium M is preheated, a decrease in temperature of the medium M and a decrease in heating efficiency of the medium M can be prevented.

(3) The guide member 32 including the guide surface 31 that guides the medium M is vibrated, and thus the medium M being transported on the vibration transport path FP1 is vibrated. In such a way, a configuration that vibrates the medium M being transported on the vibration transport path FP1 is easily provided.

(4) Since the guide member 32 located at the extended position is located vertically above the holding member 21, the guide member 32 is able to function as a hood for covering the roll body R1 held by the holding member 21 while the printing apparatus is not used. Therefore, even when the use of the printing apparatus 10 is suspended with the roll body R1 remaining held by the holding member 21 of the feeding unit 20, foreign substances are prevented from being deposited on the top portion of the roll body R1.

(5) Since the location of the guide member 32 can be changed between the extended position and the retracted position, the guide member 32 is placed at the retracted position when the roll body R1 is attached to and detached from the holding member 21 of the feeding unit 20, and thus user's workability is enhanced.

Note that the exemplary embodiment described above may be modified as follows.

Figure 4:
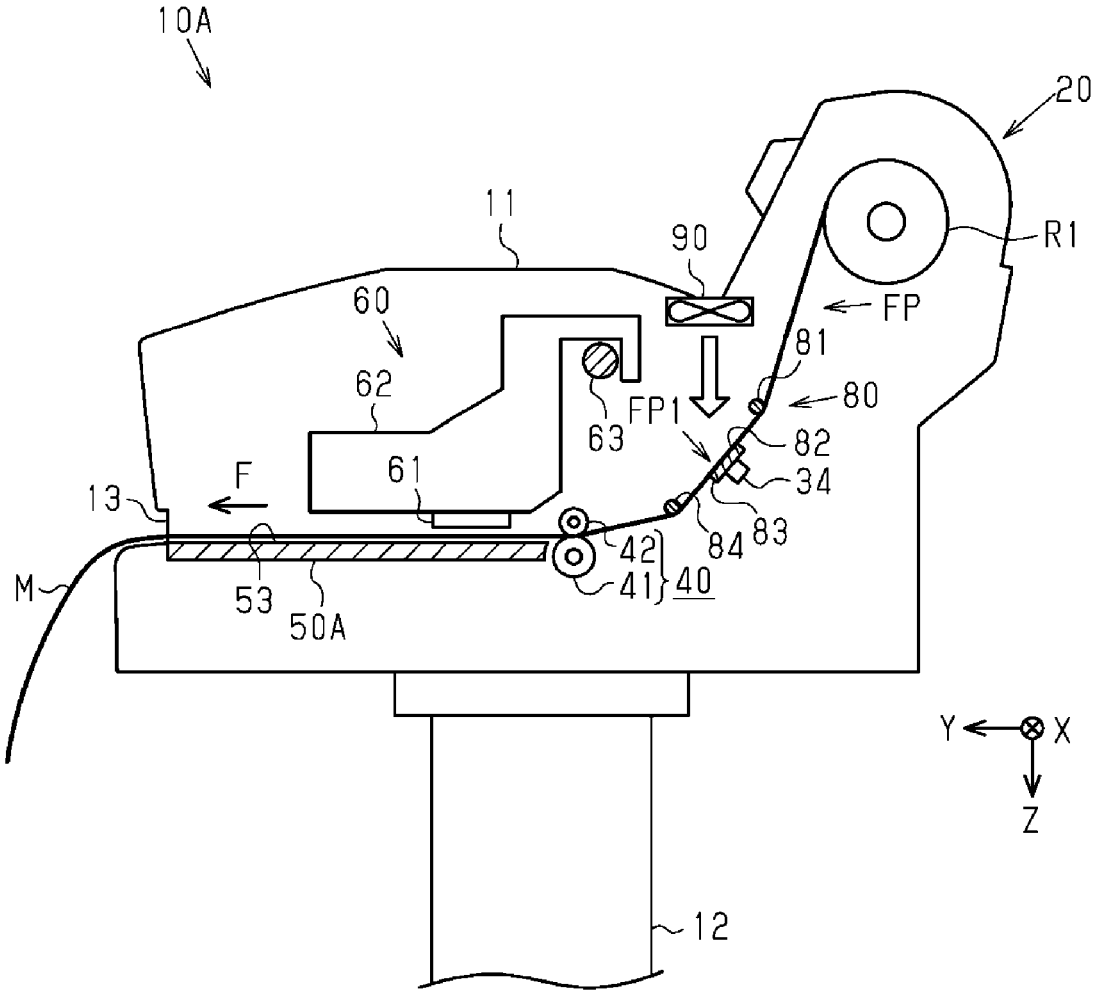
FIG. 4 is a side view schematically illustrating a configuration of a printing apparatus according to another exemplary embodiment.

The printing apparatus 10 may be a printing apparatus 10A as illustrated in FIG. 4. Note that in a description of the printing apparatus 10A illustrated in FIG. 4, like reference numerals are used to denote the same parts as in the exemplary embodiment described above and the associated description will be omitted.

As illustrated in FIG. 4, the printing apparatus 10A according to another exemplary embodiment includes, along the transport direction F of the medium M, the feeding unit 20 that feeds the medium M from the roll body R1, the guide unit 80 that guides the medium M, a blowing unit 90 that blows gas against the medium M, the transport unit 40 that transports the medium M, a support unit 50A that supports the medium M, and the printing unit 60 that performs printing on the medium M. The printing apparatus 10A also includes the housing 11, the leg portion 12, and a discharge port 13 for discharging the medium M which has been subjected to printing outside of the housing 11.

The feeding unit 20 is provided at a position vertically above and behind the housing 11 of the printing apparatus 10A. In other words, the feeding unit 20 is arranged at a position vertically above and behind the discharging unit 61 of the printing unit 60. Accordingly, the medium M fed from the feeding unit 20 is transported vertically downward as approaching to the front of the printing apparatus 10A.

The guide unit 80 includes, along the transport direction F, a first guide roller 81 that comes in contact with the front surface of the medium M, a guide plate 83 including a guide surface 82 that comes in contact with the back surface of the medium M, and a second guide roller 84 that comes in contact with the front surface of the medium M. The guide unit 80 also includes the vibration unit 34 that vibrates the guide plate 83. The first guide roller 81, the guide plate 83, and the second guide roller 84 are provided across the width direction X of the printing apparatus 10A. The first guide roller 81 and the second guide roller 84 are provided to undergo a driven rotation, following the transportation of the medium M, about the width direction X as a rotating shaft direction.

Further, in the exemplary embodiment, the first guide roller 81, the guide plate 83 (guide surface 82), and the second guide roller 84 constitute a part of the transport path FP of the medium M, and the guide plate 83 (guide surface 82) constitutes the vibration transport path FP1.

The blowing unit 90 corresponds to an example of an "airflow generating unit", and blows a gas from the outside of the housing 11 against the guide surface 82 of the guide plate 83, as illustrated by an outline arrow in FIG. 1. Accordingly, while the printing apparatus 10A is transporting the medium M to perform printing on the medium M, an airflow is generated on the front surface of the medium M which is subjected to vibration by the guide plate 83, that is, the front surface of the medium M being transported on the vibration transport path FP1.

According to the printing apparatus 10A illustrated in FIG. 4, the medium M fed from the roll body R1 held by the holding member 21 is vibrated by the guide plate 83 that vibrates before the medium M reaches the transport unit 40. Further, against the medium M guided to the guide plate 83 which is subjected to vibration by the vibration unit 34, a gas is blown by the blowing unit 90. Accordingly, foreign substances separated from the front surface of the medium M by the applied vibration are removed from the front surface of the medium M by the airflow (impact flow) generated by the gas being blown against the medium M. In such a way, the medium M to which foreign substances adhere is prevented from being transported downstream from the vibration transport path FP1 in the transport direction F, and thus ink is prevented from being discharged onto the medium M to which foreign substances adhere.

In the other exemplary embodiment illustrated in FIG. 4, the blowing unit 90 may blow a gas against the medium M being transported on a flow path of the transport path FP that is downstream from the vibration transport path FP1 in the transport direction and the path that is upstream from the transport unit 40 in the transport direction, to generate an airflow flowing along the front surface of the medium M. Accordingly, even with this configuration, an advantage similar to the advantage of the other exemplary embodiment described above is obtained.

In the other exemplary embodiment illustrated in FIG. 4, the blowing unit 90 may not necessarily be provided. In this case, it may be desirable that an exhaust fan as an example of the airflow generating unit is provided. With this configuration, an exhaust unit discharges gas contained in the housing 11 to the outside of the housing 11, and an airflow generated by discharging the gas removes the foreign substances from the front surface of the medium M.

Further, in the other exemplary embodiment illustrated in FIG. 4, in a case where the carriage 62 reciprocates in the width direction X and thus an airflow is generated on the front surface of the medium M to be guided to the guide plate 83, the blowing unit 90 may not necessarily be provided. In this case, the carriage 62 that reciprocates in the width direction X corresponds to an example of the "airflow generating unit".

In the other exemplary embodiment illustrated in FIG. 4, the vibration unit 34 may be provided in at least one of the first guide roller 81 and the second guide roller 84 to vibrate the guide rollers 81 and/or 84. In this case, the guide plate 83 may not be provided.

The exemplary embodiment described above has such a configuration in which vibration is applied to the back surface opposite to the front surface of the medium M to which ink is to be discharged. However, the configuration may be such that vibration is applied to the front surface of the medium M.

The vibration unit 34 may vibrate the guide member 32 in the width direction X, may vibrate the guide member 32 in the vertical direction Z, or may vibrate the guide member 32 in the transport direction F.

The vibration unit 34 may vibrate the medium M by directly contacting the medium M. In this case, the guide surface 31 or 82 can be eliminated.

The guide plate 83 may be provided so that the guide surface 82 is along the horizontal direction. In this case, as in the other exemplary embodiment, it may be desirable to adopt such a configuration that an airflow is generated on the front surface of the medium M after vibration is applied.

A blowing type of ionizer may be provided so that the foreign substances adhering to the front surface of the medium M can be separated more easily by vibrating the guide member 32 that guides the medium M using the vibration unit 34. In this case, it may be desirable that such a blowing type of ionizer blows against the front surface of the medium M guided to the guide member 32.

In the exemplary embodiment described above, the first heating unit 54 and the second heating unit 55 may not be provided.

In the exemplary embodiment described above, the location of the guide member 32 may not be changed between the extended position and the retracted position. In other words, the guide member 32 may be arranged to be fixed at the extended position.

The printing apparatus 10 may be replaced with a printing apparatus including the discharging unit 61 that is fixed corresponding to the entire width of the medium M without the carriage 62, what is called a line head type. The discharging unit 61 in this case may be configured to include either a plurality of unit heads in which nozzles for discharging liquid as droplet are formed and which are arranged in parallel so that a recording area is over the entire width of the medium M or a single long head in which many nozzles are arranged over the entire width of the medium M so that a recording area is over the entire width of the medium M.

The liquid discharged or sprayed from the discharging units 61 is not limited to ink and, for example, may be a liquid material obtained by dispersing or mixing particles of a functional material in liquid, or the like. For example, a configuration is possible in which a liquid material, which includes material such as an electrode material, or a color material (pixel material) used in the manufacture of liquid crystal displays, electroluminescence (EL) displays, surface emitting displays, and the like in a dispersed or dissolved form, is discharged for recording.

REFERENCE SIGNS LIST

10, 10A . . . Printing apparatus, 11 . . . Housing, 12 . . . Leg portion, 13 . . . Discharge port, 20 . . . Feeding unit, 21 . . . Holding member, 30 . . . Guide unit, 31 . . . Guide surface, 32 . . . Guide member, 33 . . . Rail member, 34 . . . Vibration unit, 40 . . . Transport unit, 41 . . . Driving roller, 42 . . . Driven roller, 50, 50A . . . Support unit, 51 . . . First support portion, 52 . . . Second support portion, 53 . . . Support surface, 54 . . . First heating unit, 55 . . . Second heating unit, 60 . . . Printing unit, 61 . . . Discharging unit, 62 . . . Carriage, 63 . . . Guide shaft, 70 . . . Winding unit, 71 . . . Holding unit, 72 . . . Tension bar, 80 . . . Guide unit, 81 . . . First guide roller, 82 . . . Guide surface, 83 . . . Guide plate, 84 . . . Second guide roller, 90 . . . Blowing unit, F . . . Transport direction, FP . . . Transport path, FP1 . . . Vibration transport path, M . . . Medium, R1 . . . Roll body, R2 . . . Roll body, X . . . Width direction, Y . . . Front-back direction, Z . . . Vertical direction

The invention claimed is:

1. A liquid discharging apparatus comprising:

a holding member configured to hold a roll body on which a medium is wound;

a transport unit configured to transport the medium fed from the roll body held by the holding member along a transport path in a transport direction;

a discharging unit configured to discharge liquid onto the medium transported by the transport unit;

a guide unit having a guide surface; and a vibration unit configured to apply vibration to the medium being transported from the holding member to the transport unit, wherein a path on which the medium to be subjected to vibration by the vibration unit is transported, in the transport path, is referred to as a vibration transport path, and the vibration transport path is configured to extend vertically upward as approaching from the holding member to the transport unit, wherein the guide surface constitutes the vibration transport path, and wherein the vibration unit vibrates the guide surface to apply vibration to the medium being transported from the holding member to the transport unit.

2. The liquid discharging apparatus according to claim 1, further comprising:

a heating unit configured to heat the medium being transported on a path that is downstream from the vibration transport path in the transport direction and upstream from the transport unit in the transport direction, in the transport path.

3. The liquid discharging apparatus according to claim 1, wherein the guide unit is provided vertically above the holding member.

4. A liquid discharging apparatus comprising:

a holding member configured to hold a roll body on which a medium is wound;

a transport unit configured to transport the medium fed from the roll body held by the holding member along a transport path in a transport direction;

a discharging unit configured to discharge liquid onto the medium transported by the transport unit;

a vibration unit configured to apply vibration to the medium being transported from the holding member to the transport unit;

a guide unit having a guide surface; and an airflow generating unit configured to generate an airflow along a surface of the medium being transported on at least one of a path which is referred to as a vibration transport path of the transport path and on which the medium to be subjected to vibration by the vibration unit is transported and a path of the transport path that is downstream from the vibration transport path in a transport direction and upstream from the transport unit in the transport direction, wherein the guide surface constitutes the vibration transport path, and wherein the vibration unit vibrates the guide surface to apply vibration to the medium being transported from the holding member to the transport unit.

* * * * *